United States Patent [19]

Fischer et al.

[11] Patent Number: 4,681,017

[45] Date of Patent: Jul. 21, 1987

[54] PRACTICE AMMUNITION SYSTEM

[75] Inventors: Nikolaus H. J. Fischer, Troisdorf; Christoph Mathey, Ockenfels; Rainer Schöffl, Odenthal, all of Fed. Rep. of Germany

[73] Assignee: Dynamit Nobel Aktiengesellschaft, Troisdorf, Fed. Rep. of Germany

[21] Appl. No.: 758,441

[22] Filed: Jul. 24, 1985

[30] Foreign Application Priority Data

Jul. 24, 1984 [DE] Fed. Rep. of Germany ..... 3427165

[51] Int. Cl.[4] ..... F41F 3/055; F41F 27/00

[52] U.S. Cl. ..... 89/29; 434/12; 89/1.814; 102/529

[58] Field of Search ..... 89/29, 1.8, 1.814, 1.815, 89/1.816, 1.819, 1.811, 1.812; 42/77; 434/12, 16; 102/529

[56] References Cited

U.S. PATENT DOCUMENTS

| | | | |
|---|---|---|---|
| 2,342,684 | 2/1944 | Nelson | 434/16 |
| 3,242,593 | 3/1966 | Brenegan | 89/1.8 |
| 3,883,209 | 5/1975 | Kongelbeck | 89/1.811 |
| 4,359,926 | 11/1982 | Sano et al. | 89/1.814 |

FOREIGN PATENT DOCUMENTS

| | | | |
|---|---|---|---|
| 8501341 | 3/1985 | Australia | 89/29 |

*Primary Examiner*—Deborah L. Kyle
*Assistant Examiner*—Michael J. Carone
*Attorney, Agent, or Firm*—Antonelli, Terry & Wands

[57] ABSTRACT

A practice ammunition system for a rocket launcher having a guide tube for receiving an original rocket, the original rocket including an ignition device which, prior to launch, performs a data exchange via at least one data line with an external fire control unit for the rocket launcher. The practice ammunition system includes a practice rocket having a rocket engine and an igniter for igniting the rocket engine thereof, the practice rocket being insertable in the guide tube of the rocket launcher, a simulator external to the practice rocket arranged for connection with the practice rocket and the fire control unit with the external simulator, after connection with the training rocket and the fire control unit, simulating functions of the ignition device of the original rocket for performing a data exchange dwith the fire control unit and for enabling launching of the practice rocket from the rocket launcher.

16 Claims, 3 Drawing Figures

PRACTICE AMMUNITION SYSTEM

The present invention relates to a practice or training ammunition system for rocket launchers wherein the original or actual rockets associated with such launchers include igniters which, prior to launch, perform data interchange via data lines with an external fire control unit and wherein a training rocket is insertable in the guide device of the rocket launcher, the training rocket having an igniter for igniting its rocket engine.

For training personnel teams participating in the launching of rockets practice or, training ammunition systems are utilized, the rockets of which exhibit a simpler structure than the actual rockets and are correspondingly less expensive. Normally, the training rockets are of subcaliber size, i.e., they have a smaller external diameter than the actual rockets, but it is also possible to employ training rockets having the same dimensions as the original rockets. Modern rocket launchers are designed so that a flow of data and signals must take place between the launching device and the rocket ammunition, before the rocket can be launched. Thus, it is necessary, for example, to test certain functions of the rocket prior to launching, and to transmit to the rocket information regarding the flight path and/or the instant of ejection of ammunition or other parts. Furthermore, the battery contained in the rocket is activated only a short time prior to launch. For this purpose, the rocket launcher is equipped with a fire control device which, prior to the launch, entertains a dialogue with the igniter constituting the central data consolidating unit of the rocket.

If it is intended to launch training rockets from such a rocket launcher, a data and signal flow is likewise required in this case before the fire control unit gives the clearance for launching of the rocket. According to the state of the art, the training rockets are equipped with the same igniter as the actual rockets, i.e., the same complex electronic functions are performed in the training rocket as in the original rocket. The igniters are expensive, and their structural size and mounting are designed, in some rockets, so that such igniters cannot at all be utilized in subcaliber rockets.

It is, therefore, an object of the present invention to provide a practice or training ammunition system of the type discussed above which makes it possible to launch also those practice training rockets that are not equipped with the igniter of the original rocket.

In accordance with the present invention, a practice or training rocket ammunition system is provided with an external simulator and the igniter of the training rocket is connectible to the simulator wherein the simulator after the igniter has been connected thereto, simulates the additional functions of the original rocket and, based on these simulated functions, performs data interchange with the firing control unit.

According to this invention, a simulator is arranged outside of the training rocket, simulating those functions which, in original rockets, are executed at or in the rocket. It is thereby made possible to employ simpler and more economical training rockets. By the interposition of the simulator between the rocket and the fire control unit, the fire control unit is, so to speak, fooled into the assumption that an original rocket is present in the tube of the rocket launcher. Data exchange between the fire control unit and the simulator takes place in the same manner as the data exchange between the fire control unit and the igniter and/or data installation of an original rocket. Since the simulator is not a part of the training rocket, but rather remains with the rocket launcher, the simulator can be used as often as desired. The expensive electronic system of the simulator is not destroyed after launching of the rocket. Another advantage resides in that the training rockets need not contain a data-processing unit but rather there is merely the necessity of checking the functions of the igniter of the rocket engine prior to launching. Subcaliber rockets can be launched from the tube of the rocket launcher, which rockets do not have an igniter filling the tube cross section.

The simulator, which can be connected to the fire control unit by way of multiple plugs, is suitably mounted at the rocket launcher. The simulator can also be arranged at an exchangeable launch pod container of the rocket launcher. The important feature is that the simulator does not participate in the rocket launch and is not destroyed together with the rocket.

The simulator can contain modules from the igniter of an actual rocket and/or can essentially consist of such an igniter.

These and further objects, features and advantages of the present invention will become more obvious from the following description when take in connection with the accompanying drawings wherein.

Figure 1:
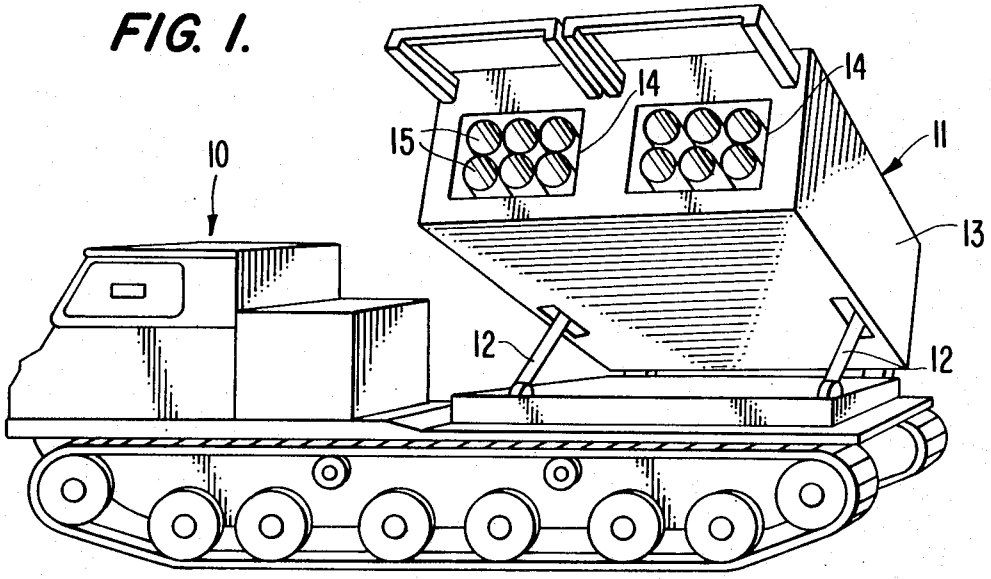
FIG. 1 is a perspective view of a rocket launcher mounted on a vehicle.

Referring now to the drawings, there is shown in FIG. 1, a rocket launcher 11 mounted on a vehicle 10. The rocket launcher 11 can be placed in an inclined position by means of hydraulic cylinders 12 in order to set the launching angle with respect to the horizontal.

In the illustrated embodiment, the rocket launcher 11 is a multiple launcher with a housing 13 which can accommodate two launch pod containers 14, each of which contains six launching tubes 15. Each tube 15 is adapted for receiving one rocket, so that, in total, twelve rockets can be launched by the rocket launcher 11 without reloading. FIG. 1 shows the rocket launcher 11 in the unloaded condition, i.e., without original rockets.

Figure 2:
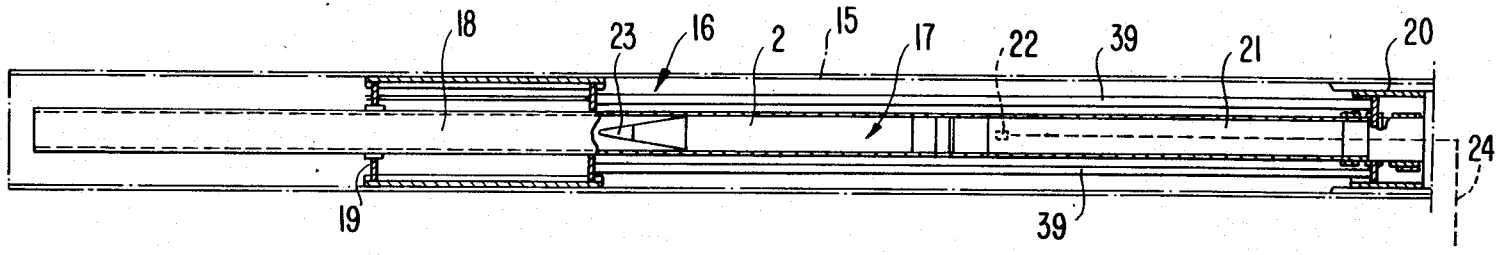
FIG. 2 is a schematic illustration of the arrangement of an adaptor device in one of the tubes of the rocket launcher.

According to FIG. 2, an adaptor 16 is provided a respective one of the tubes 15, serving for accommodation of a subcaliber practice or training rocket 17. The adaptor 16 includes a practice or training tube 18 which, with respect to the tube 15, is of subcaliber size and extends coaxially to the tube 15. The training tube 18 is equipped with a stellate supporting member 19 centering the training tube in the interior of the tube 15. From the stellate supporting member 19, rods 39 extending in the longitudinal direction of the tube 15 lead to a supporting device 20 which positions the training tube 18 at its rear end in the tube 15.

The training rocket 17 is fired out of the training tube 18. The training rocket 17 contains a propellant charge 21, an igniter 22 for activating the propellent charge, an explosive charge 2 and, at its tip, an impact detonator for the explosive charge 2. The igniter 22 is a simplified igniter with respect to the igniter of an original rocket.

From the igniter 22, an ignition line 24 leads out of the training rocket 17. By application of an ignition voltage to the ignition line 24, the igniter 22 is activated and the propellant charge 21 is ignited. The associated grounded line, connecting the igniter 22 with the ground potential of the launch pod container 14, is not illustrated.

Figure 3:
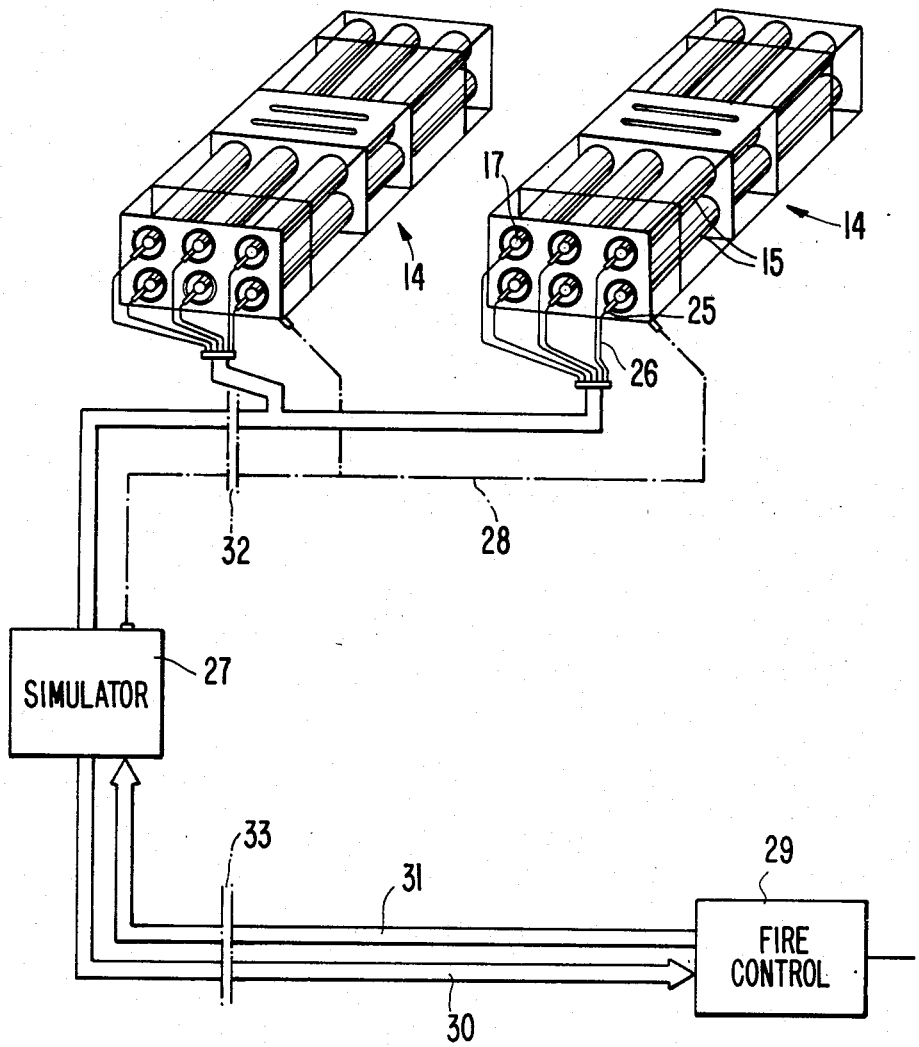
FIG. 3 is a block circuit diagram of the connection of several training rockets to the fire control unit of the rocket launcher by way of the simulator according to the present invention.

As shown in FIG. 3, a training rocket 17 can be inserted in the aforedescribed way in each of the tubes 15 of a launch pod container 14. The ignition line 24 is connected via a plug 25 to a connecting line 26 leading to the simulator 27. Furthermore, the simulator 27 is connected via a grounded line 28 with each of the launch pod containers 14. By the application of a test voltage to each of the connecting lines 26, the function of the respective igniter 22 can be checked by the simulator 27.

The simulator 27 is connected to the first control unit 29 of the rocket launcher 11. For reasons of clarity, this connection is illustrated in such a way that a conductor bundle 30 transmits data from the simulator 27 to the fire control unit 29, and that another conductor bundle 31 transmits data from the fire control unit 29 to the simulator 27. The simulator 27 contains the essential structural modules of the igniter of an origianl rocket and checks whether the training rockets 17 housed in the launch pod containers 14 are ready for launch. If this readiness for launching is present, then the simulator 27 simulates the functions of an actual rocket, data being exchanged in both directions between the electronic simulator 24 and the fire control unit 29. After termination of this data exchange or dialogue, the fire control unit 29, via the simulator 27, effects ignition of the igniters 22 of the training rockets in succession or jointly.

The simulator 27 is connected by way of multiple plugs 32, 33 with the training rockets 17, on the one hand, and with the fire control unit 29, on the other hand. The simulator 27 can thus be selectively connected to the fire control unit 29, whenever training rockets are to be launched. Upon the launching of each training rocket, the ignition line 24 is severed from the connecting line 26.

In the present embodiment, one simulator 27 is provided for the training rockets of two launch pod containers 14. In this case, the simulator 27 is arranged at the housing 13 of the rocket launcher 11. It is also possible to provide respectively one simulator for each launch pod container 14 and to mount this simulator directly at the launch pod container.

While we have shown and described one embodiment in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims.

What is claimed is:

1. A practice ammunition system for a rocket launcher having guide means for receiving an original rocket, the original rocket including an ignition means which, prior to launch, performs a data exchange via at least one data line with an external fire control unit for the rocket launcher, the practice ammunition system comprising a practice rocket having a rocket engine and an igniter for igniting the rocket engine thereof, the practice rocket being insertable in the guide means of the rocket launcher, simulator means external to the practice rocket arranged for connection with the practice rocket and the fire control unit, the external simulator means, after connection with the practice rocket and the fire control unit, simulating functions of the ignition means of the original rocket for performing a data exchange with the fire control unit and for enabling launching of the practice rocket from the rocket launcher.

2. A practice ammunition system according to claim 1, wherein the ignition means of the original rocket includes a module for at least performing data exchange with the external fire control unit, the simulator means containing the module of an ignition means of an original rocket.

3. A practice ammunition system according to claim 1, wherein the igniter of the training rocket is provided with a signal line extending therefrom, the simulator means including plug means for connection with the signal line of the igniter for at least transmitting an ignition pulse thereto so as to enable launch of the practice rocket from the rocket launcher.

4. A practice ammunition system according to claim 1, wherein the practice rocket is a subcaliber rocket, the guide means of the rocket launcher including a first guide tube for receiving an original rocket of an original caliber, a second guide tube for a subcaliber rocket and supporting means therefor being inserted in the first guide tube, the subcaliber practice rocket being received within the second guide tube so as to enable launch therefrom.

5. A practice ammunition system according to claim 1, wherein the rocket launcher comprises a plurality of guide means for receiving respective original rockets therein, a plurality of practice rockets being received in the guide means of the rocket launcher and the simulator means being connectible with respective practice rockets and the external fire control unit.

6. A practice ammunition system according to claim 1, wherein the simulator means includes electrical means for electrically connecting the practice rocket and the fire control unit for performing an electrical data exchange with the fire control unit and for electrically enabling launching of the practice rocket from the rocket launcher.

7. A practice ammunition system according to claim 1, wherein the simulator means is arranged externally of the guide means of the rocket launcher.

8. A practice ammunition system according to claim 1, wherein the simulator means is mounted on the rocket launcher.

9. A practice ammunition system according to claim 8, wherein the ignition means of the original rocket includes a module for at least performing data exchange with the external fire control unit, the simulator means containing the module of an ignition means of an original rocket.

10. A practice ammunition system according to claim 1, wherein the simulator means is secured to an exchangeable launch pod container of the rocket launcher.

11. A practice ammunition system according to claim 10, wherein the ignition means of the original rocket includes a module for at least performing data exchange with the external fire control unit, the simulator means containing the module of an ignition means of an original rocket.

12. A practice ammunition system according to claim 5, wherein the igniter of each practice rocket is provided with a signal line extending therefrom, the simulator means including first plug means for connection with respective signal lines of the practice rockets and second plug means for connection with the fire control unit.

13. A practice ammunition system according to claim 12, wherein the simulator means is mounted on the rocket launcher.

14. A practice ammunition system according to claim 12, wherein the simulator means is secured to an exchangeable launch pod container of the rocket launcher.

15. A practice ammunition system according to claim 12, wherein the ignition means of the original rocket includes a module for at least performing data exchange with the external fire control unit, the simulator means containing the module of an ignition means of an original rocket.

16. A practice training ammunition system according to claim 12, wherein the practice rocket is a subcaliber rocket, the guide means of the rocket launcher including a first guide tube for receiving an original rocket of an original caliber, a second guide tube for a subcaliber rocket and supporting means therefore being inserted in the first guide tube, the subcaliber practice rocket being received within the second guide tube so as to enable launch therefrom.

* * * * *